US007327339B2

(12) United States Patent
Akimoto et al.

(10) Patent No.: US 7,327,339 B2
(45) Date of Patent: Feb. 5, 2008

(54) IMAGE DISPLAY APPARATUS AND DRIVING METHOD THEREOF

(75) Inventors: Hajime Akimoto, Ome (JP); Yoshiro Mikami, Hitachiota (JP)

(73) Assignee: Hitachi, Ltd. (JP)

( * ) Notice: Subject to any disclaimer, the term of this patent is extended or adjusted under 35 U.S.C. 154(b) by 7 days.

(21) Appl. No.: 09/938,643

(22) Filed: Aug. 27, 2001

(65) Prior Publication Data

US 2002/0093495 A1 Jul. 18, 2002

(30) Foreign Application Priority Data

Jan. 15, 2001 (JP) ..... 2001-005894

(51) Int. Cl.
*G09G 3/36* (2006.01)

(52) U.S. Cl. ..... 345/89; 345/87; 345/88; 345/92; 345/100; 345/206

(58) Field of Classification Search ..... 345/89, 345/87–88, 92, 100, 204, 206
See application file for complete search history.

(56) References Cited

U.S. PATENT DOCUMENTS 5,528,241 A * 6/1996 Negishi et al. ..... 341/144
6,169,509 B1 * 1/2001 Abe
6,181,314 B1 * 1/2001 Nakajima et al. ..... 345/100
6,191,720 B1 * 2/2001 Zhang ..... 341/145
6,215,465 B1 * 4/2001 Asakura et al. ..... 345/87
6,229,508 B1 * 5/2001 Kane ..... 345/82
6,323,849 B1 * 11/2001 He et al. ..... 345/204
6,344,984 B1 * 2/2002 Miyazaki ..... 363/60
6,366,065 B1 * 4/2002 Morita ..... 323/280
6,388,653 B1 * 5/2002 Goto et al. ..... 345/98
6,448,836 B2 * 9/2002 Kokubun et al. ..... 327/307
2001/0028336 A1 * 10/2001 Yamagata et al. ..... 345/98

FOREIGN PATENT DOCUMENTS

| | | |
|---|---|---|
| EP | 0 899 714 A2 | 3/1999 |
| JP | 61-159621 | 7/1986 |
| JP | 10-301539 | 11/1998 |
| JP | 11-73165 | 3/1999 |
| JP | 11-271708 | 10/1999 |

* cited by examiner

*Primary Examiner*—Richard Hjerpe
*Assistant Examiner*—Leonid Shapiro
(74) *Attorney, Agent, or Firm*—Dickstein Shapiro LLP

(57) ABSTRACT

A display drive circuit has impedance converters between gray level voltage wires and a ladder resistor. At the time of writing analog image signal voltages onto signal lines, the writing can be done in three separate phases.

21 Claims, 8 Drawing Sheets

IMAGE DISPLAY APPARATUS AND DRIVING METHOD THEREOF

BACKGROUND OF THE INVENTION

The present invention relates to an image display apparatus permitting improvement in yield and in image quality.

A polycrystalline Si thin film transistor (TFT) having an offset canceler, using a source follower circuit configuration as a buffer amplifier, such as ones described in JP-A-11-73165 (corresponding to EP 0899714A2) and JP-A-10-301539, involves the following problems.

First of all, there is a problem that building in as many analog active circuits such as a buffer amplifier as signal lines pulls down the yield. Whereas buffer amplifiers are configured by monocrystalline Si transistors excelling in the uniformity of characteristics in an amorphous Si TFT panel, a polycrystalline Si TFT is susceptible to unevenness in characteristics due to many defect levels distributed in a channel, resulting in inevitable unevenness in the characteristics of the buffer amplifiers, and this pulls down the yield.

A second problem is the inferior capability of an offset canceler using a polycrystalline Si TFT to that of what is configured by a monocrystalline Si transistor. Since a polycrystalline Si TFT does not permit as fine machining as a monocrystalline Si transistor does, the parasitic capacitance of each switch of the offset canceler becomes inevitably large, and moreover the parasitic capacitances are more uneven. This directly leads to greater errors in the canceling output of the offset canceler, and invites, again directly, a poorer S/N ratio of image quality.

SUMMARY OF THE INVENTION

According to one aspect of the invention pertaining to the present application, an image display apparatus has a display unit for displaying an image and a drive unit for driving this display unit, the display unit being connected by a plurality of signal lines, in which the display unit comprises of a plurality of display pixels arranged in a matrix form, and the drive unit has a ladder resistor, impedance converters connected to the ladder resistor, gray level voltage wires constituting output lines from the impedance converters, and a gray level voltage selector connected to the gray level voltage wires.

Further, the gray level voltage selector is connected to a plurality of signal lines.

According to another aspect of the invention, an image display terminal system has a plurality of display pixels arranged in a matrix form to display an image, a group of signal lines provided for each column to transmit analog image signals and connected to the display pixels, a drive circuit for driving the display pixels and the group of signal lines at prescribed timings, and a circuit for causing the display pixels to display an image in a prescribed sequence on the basis of inputted image display data, in which the drive circuit has a ladder resistor and a plurality of gray level voltage wires connected to the ladder resistor, the group of signal lines are connected to the gray level voltage wires via a gray level voltage selector, each gray level voltage wire is connected to the ladder resistor via impedance converters, and at least the display pixels, the group of signal lines, the gray level voltage selector and the gray level voltage wires are provided over a single substrate.

According to these aspects of the invention, analog active circuits such as the impedance converters need not be as many as the number of signal lines but are sufficient in the same number as the gray level voltage wires. Calculation of this factor by a panel of common intermediate format (CIF) of four-bit display data, whose common pixel electrodes are A.C.-driven, reveals a reduction from (352×RGB=1056) to $2^4$=16, representing a significant yield enhancement.

DESCRIPTION OF THE EMBODIMENTS

Embodiment 1

Embodiment 1 of the present invention will be described below with reference to FIG. 1 through FIG. 5.

First will be described an overall configuration of this Embodiment 1.

Figure 1:
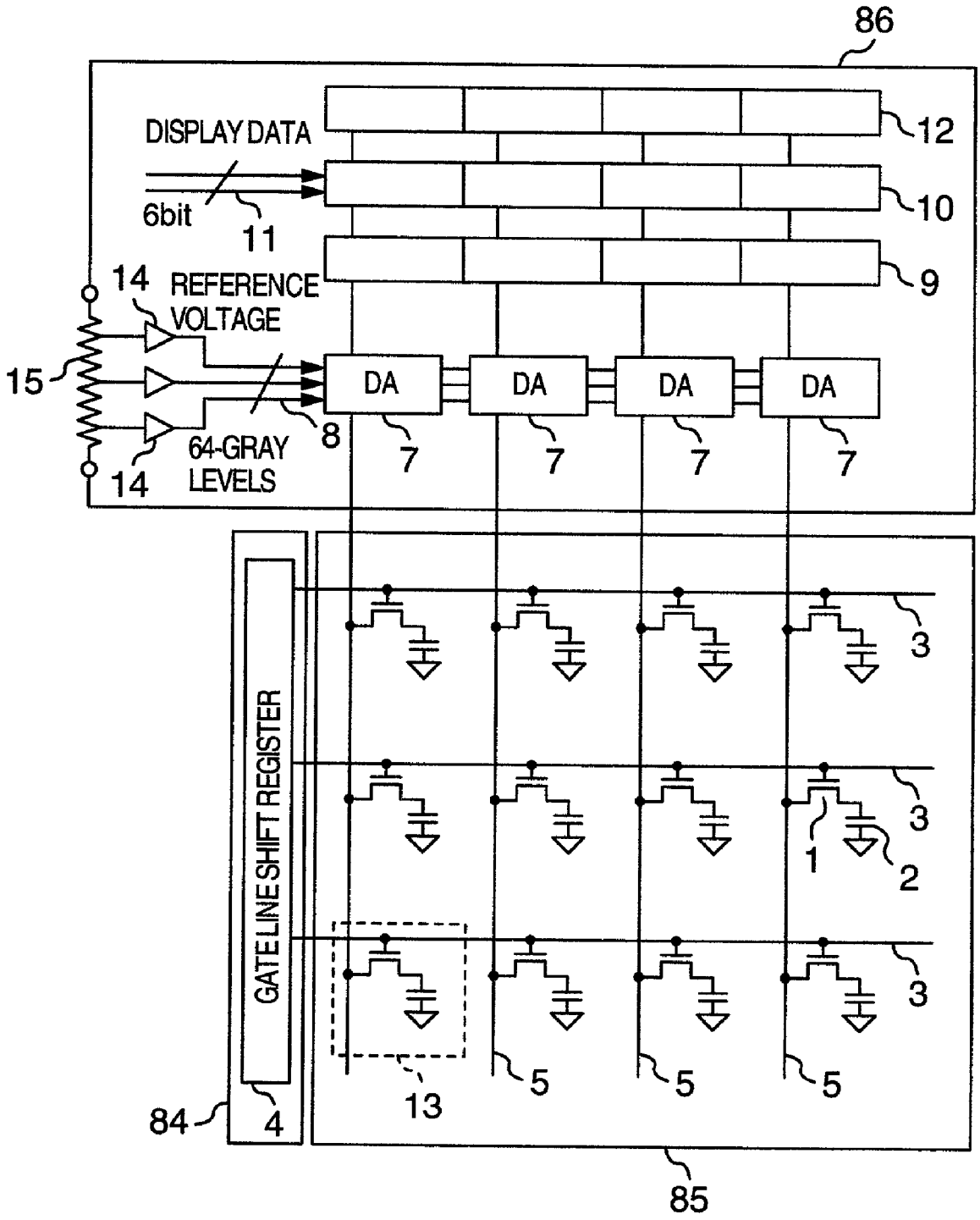
FIG. 1 illustrates a configuration of a polycrystalline Si-TFT liquid crystal display panel, which is Embodiment 1 of the present invention.

FIG. 1 illustrates a configuration of a polycrystalline Si-TFT liquid crystal display panel, which is Embodiment 1 of the invention.

Display pixels 13 each having a pixel switch 1 comprising a liquid crystal capacitance 2 and a polycrystalline Si-TFT are arranged in a matrix form, and a gate of each pixel switch 1 is connected to a gate line shift register 4 via a gate line 3. One end of the pixel switch 1 is connected to a DA converter 7 via a signal line 5. A line memory 9 inputs to the DA converter 7, and to a line memory 9 is connected a data latch 10, to which is connected a horizontal shift register 12. Reference voltage lines 8, commonly inputting to the DA converters 7 here, are connected to a ladder resistor 15 via buffer amplifiers 14. Display data lines 11 commonly input to the data latches 10. Incidentally, for the sake of simplicity of illustration, no representation is made here of such general structures necessary for constituting a color TFT panel as the common electrode, color reflector and back light configuration of the liquid crystal and the input section for the display data lines 11 because they are usual elements of configuration. The plurality of display pixels 13 constitute a display pixel matrix (or a display unit). A configuration having the horizontal shift registers 12, the data latches 10 and the DA converters 7 constitutes a horizontal drive circuit 86. The term "drive circuit" may as well refer to a configuration having a gate line selecting circuit 84, including the gate line shift register 4, and the horizontal drive circuit 86.

Next, the overall operation of this Embodiment 1 will be described. Detailed structure and operation of each part will be sequentially explained later in the description of each individual constituent element.

Display data entered via the display data lines 11 are successively latched to the data latches 10 by the horizontal shift registers 12. Then, these latched display data are transferred to the line memories 9 in every horizontal input period and entered into the DA converters 7. The DA converters 7, on the basis of a reference voltage entered from the reference voltage lines 8, supply analog image signal voltages, having these display data as their digital inputs, to the signal line 5. Then, as the pixel switch 1 of a prescribed display pixel row selected by the gate line shift register 4 is turned on, the aforementioned analog image signal voltage supplied to the signal line 5 is written into the liquid crystal capacitance 2 of the selected display pixels. By the operation so far described, this TFT liquid crystal panel displays an image based on the entered display data. The reference voltage entered onto the reference voltage lines 8 here is generated on the basis of the reference voltage generated by the ladder resistor 15 by using the buffer amplifiers 14 as required.

The constituent elements and their actions in different parts of this embodiment will be described below in a due sequence.

Horizontal Shift Register 12, Data Latch 10, Line Memory 9 and DA Converter 7:

The configurations and actions of the horizontal shift register 12, the data latch 10, the line memory 9 and the DA converter 7 will be described below with reference to FIG. 2.

Figure 2:
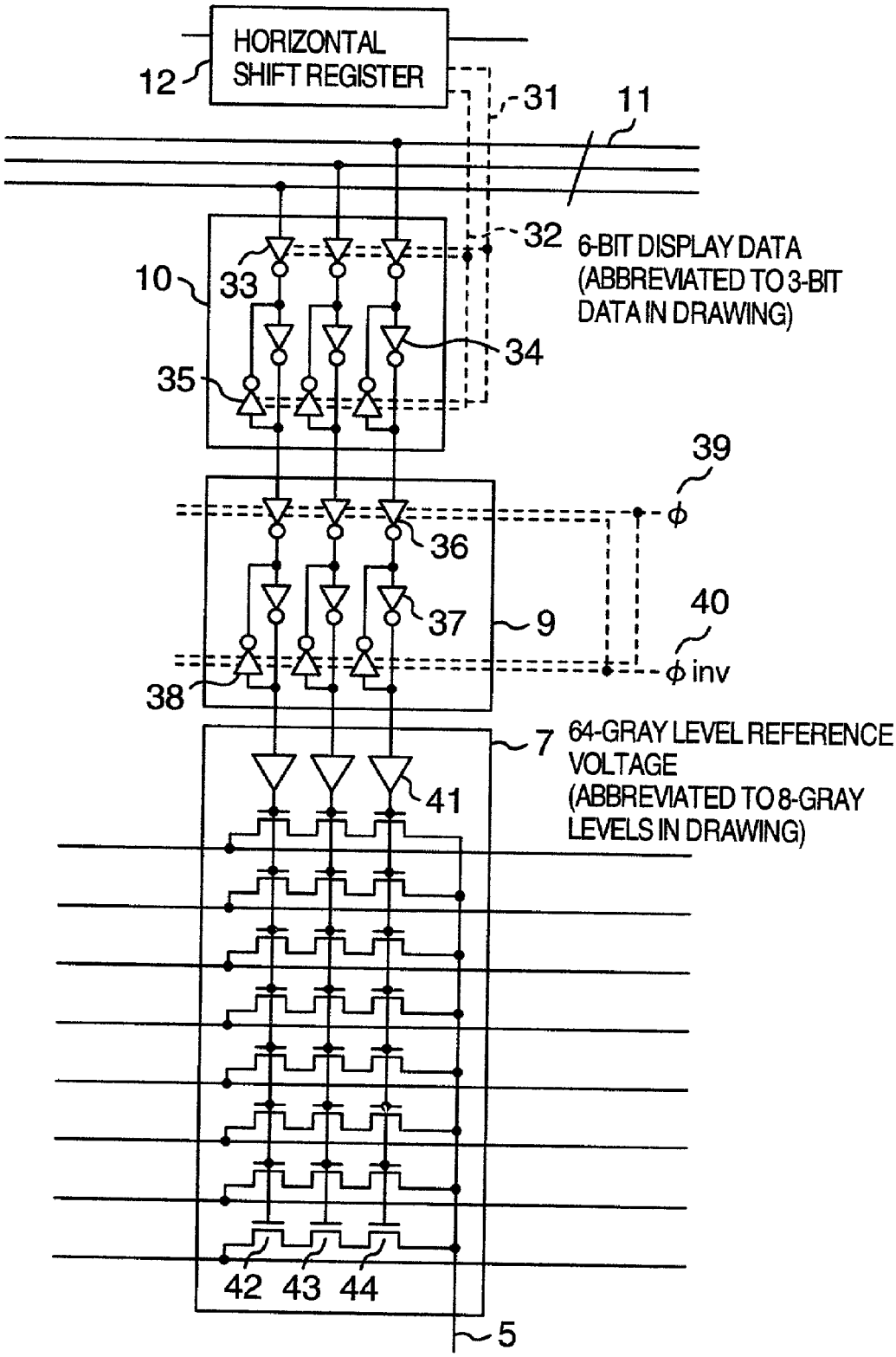
FIG. 2 illustrates configurations of a horizontal shift register, a data latch, a line memory and a DA converter in Embodiment 1.

FIG. 2 illustrates the configurations of the horizontal shift register 12, the data latch 10, the line memory 9 and the DA converter 7 matching one signal line 5. From the horizontal shift register 12, two mutually inverting latch signal wires 31 and 32 extend to the data latch 10. The data latch 10 is configured by clocked inverters 33 and 35 and an inverter 34 for each bit of display data, and the display data lines 11 are connected to its input. Although the display data are actually six-bit data, they are illustrated here as three-bit display data to simplify illustration. The output of the data latch 10 is further entered into the line memory 9 configured by clocked inverters 36 and 38 and an inverter 37 for each bit of display data, and each line memory is controlled with mutually inverting latch signal wires 39 and 40. Further, the output of the line memory 9 is entered into the voltage selecting type DA converter 7. The selected voltage here is supplied via the reference voltage lines 8 matching the number of analog gray levels, and the display data supplied from the line memory 9 are entered into gray level selecting transistors 42, 43 and 44 via a level shift circuit 41. In this drawing, the gray level selecting transistor 42 matches the most significant bit (MSB) and the gray level selecting transistor 44, the least significant bit (LSB). As illustrated, for the gray level selecting transistors 42, 43 and 44, nMOS and pMOS transistors are deliberately selected to achieve such a configuration as will invert its on/off characteristic according to the DA conversion characteristic. The output of the DA converter 7 is directly connected to the signal line 5.

The actions of the horizontal shift register 12, the data latch 10, the line memory 9 and the DA converter 7 will be described below. The horizontal shift register 12 enters latch pulses at prescribed timings onto the data latch 10 via the latch signal wires 31 and 32 in response to a drive signal synchronized with the display data entered onto the display data lines 11. This causes the data latch 10 to sample display data entered onto the display data lines 11 and to take the display data into a latch circuit configured by the clocked inverters 35 and the inverter 34. These display data are transferred to the line memory 9 in every row write period (one horizontal input period) by the line latch wires 39 and 40 driven at prescribed timings, and further latched. These latched data, after undergoing amplitude modulation by the level shift circuit 41, are entered into the gate of a voltage selection matrix consisting of gray level selecting transistors 42, 43 and 44, and the reference voltage that is selected as a result is supplied to the signal line 5.

Although the clocked inverters and inverter in this embodiment are configured by CMOS circuits using polycrystalline Si TFTs, obviously they can have other circuit configurations having similar functions. Further, as the horizontal shift register 12, the data latch 10 and the line memory 9 are configured by low voltage-driven circuits of 5 V in amplitude to save power consumption, the level shift circuit 41 is provided between them and the gates of the gray level selecting transistors 42, 43 and 44 to amplify the voltage amplitude to 10 V, if the horizontal shift register 12, the data latch 10, the line memory 9 or the like are driven with a large voltage amplitude of 10 V or so from the outset, evidently the level shift circuit 41 can be dispensed with. It is also possible to give the matrix of the gray level selecting transistor 42, 43 and 44 a CMOS analog switch configuration, and in this case again it is possible to dispense with the voltage reduction by the level shift circuit 41 or the level shift circuit 41 itself.

Details of Buffer Amplifiers 14 and Ladder Resistor 15:

The configurations and actions of the buffer amplifiers 14 and the ladder resistor 15 will be described below with reference to FIG. 3.

Figure 3:
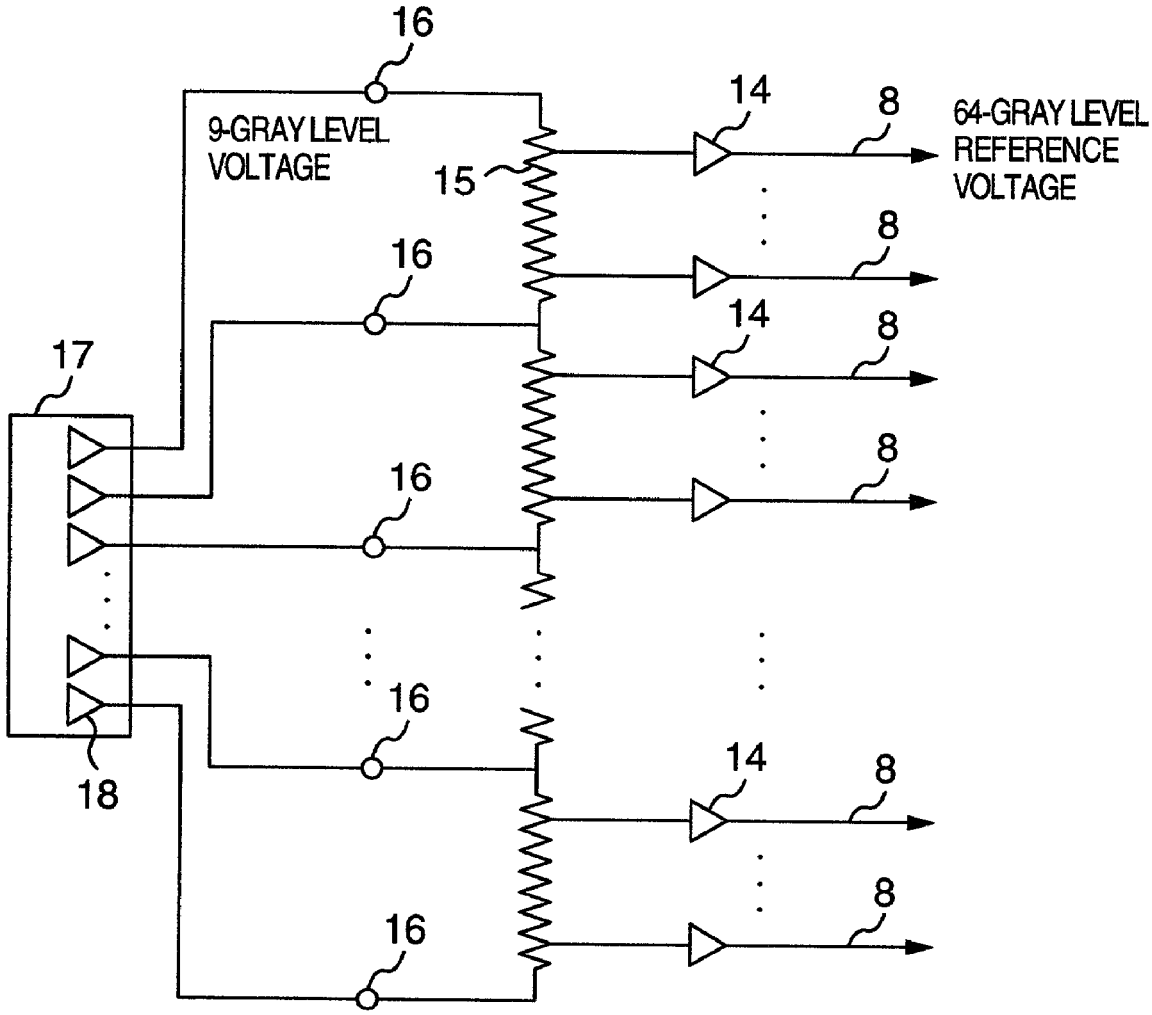
FIG. 3 illustrates circuit configurations of and around buffer amplifiers and a ladder resistor in Embodiment 1.

FIG. 3 illustrates the circuit configurations of and around buffer amplifiers 14 and the ladder resistor 15. The ladder resistor 15 is provided with nine external circuit connection terminals 16, to each of which is connected the output of a reference voltage generating amplifier 18 of a reference voltage generating circuit 17, which is a Si-large scale integrated circuit (Si-LSI). The ladder resistor 15 has, among respective two external circuit connection terminals 16, eight buffer amplifiers 14, whose outputs are connected to reference voltage lines 8. There are altogether 64 buffer amplifiers 14, and this number matches the aforementioned six-bit structure of the display data.

Whereas the ladder resistor 15 is used here to generate 64 gray levels of reference voltages without allowing gray levels to be inverted by any error, the reference voltage generating circuit 17 is used for adjusting the 64 gray levels of reference voltages. Whereas the buffer amplifiers 14 are used to restrain the impact of load capacitances attributable to the signal lines 5 connected to the reference voltage lines 8 on the ladder resistor 15, this point will be described in further detail afterwards.

Although this embodiment requires reference voltage lines 8 for 64 gray levels because of the six-bit structure of display data, obviously the reference voltage lines 8 will be needed for $2^n$ gray levels if n-bit display data are used. Further in this embodiment the reference voltage generating circuit 17 is composed of an Si-LSI, various other alternatives, including a configuration using different individual components, are conceivable without deviating from the essence of the invention. If the reference voltage generating circuit 17 here is integrally composed of a polycrystalline Si TFT circuit like the buffer amplifiers 14 to be described in detail below, evidently the external circuit connection terminals 16 can be dispensed with.

Details of Buffer Amplifier 14:

The specific configuration and actions of the buffer amplifier 14 will be described below with reference to FIG. 4 and FIG. 5.

Figure 4:
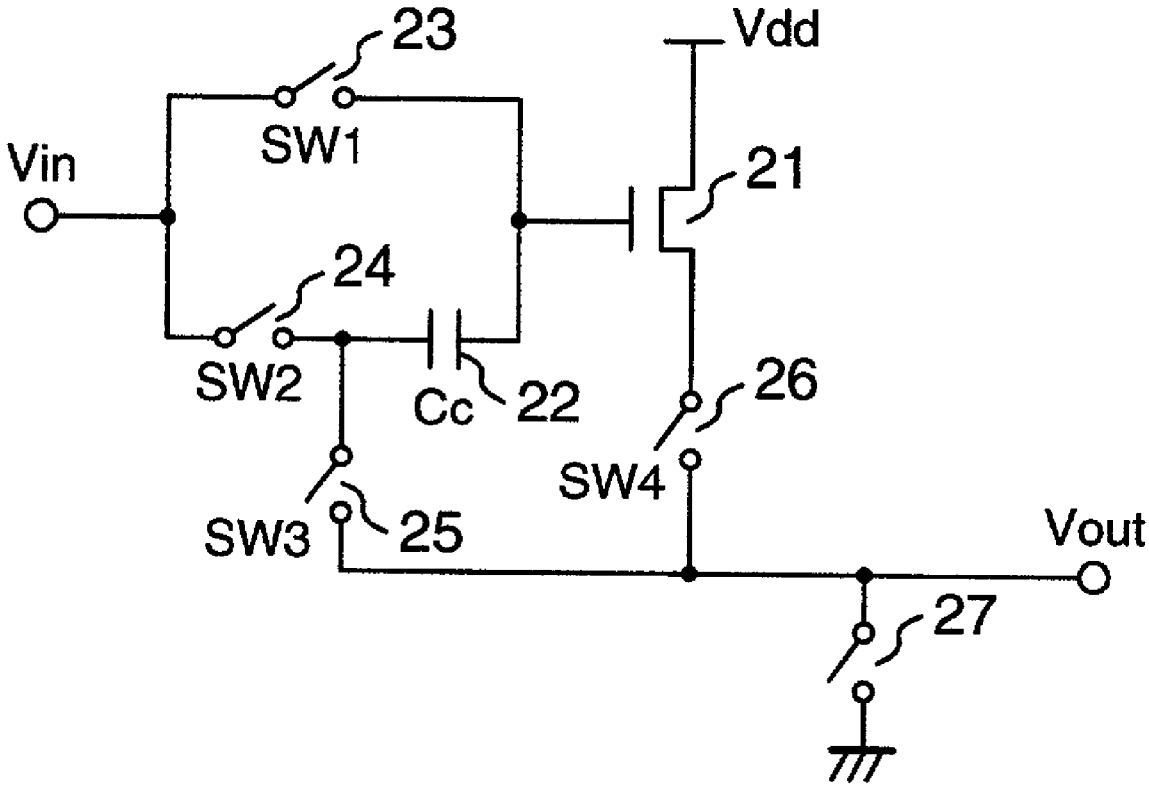
FIG. 4 illustrates a circuit configuration of the buffer amplifier in Embodiment 1.
Figure 5:
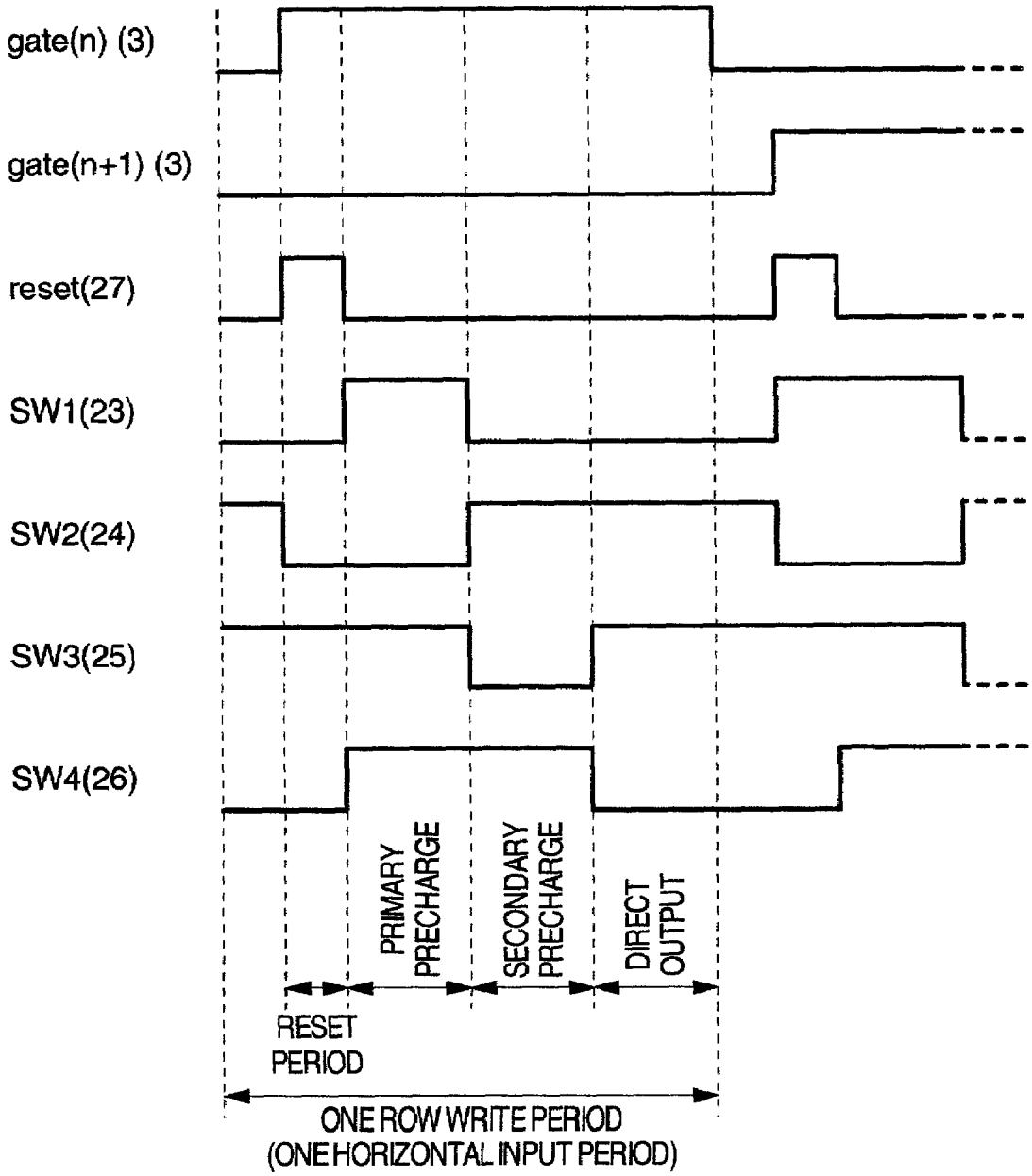
FIG. 5 is a timing chart of actions of the buffer amplifier in Embodiment 1.

FIG. 4 illustrates the circuit configuration of the buffer amplifier 14. The essential part of the amplifier is a drain-grounded n-channel TFT 21 whose drain is connected to a constant voltage power source Vdd. The gate of the TFT 21 is connected to a switch 1 (SW1) 23 and an offset canceling capacitance Cc22, and the other end of the switch 1 (SW1) 23, together with one end of a switch 2 (SW2) 24, is connected to the input section Vin of the buffer amplifier 14. The respective other ends of the offset canceling capacitance Cc22 and the switch 2 (SW2) 24 commonly input to one end of a switch 3 (SW3) 25, and the other end of the switch 3 (SW3) 25 is the output section Vout of the buffer amplifier 14. The source of the TFT 21 is also connected to the output section Vout of the buffer amplifier 14 via a switch 4 (SW4) 26. The output section Vout of the buffer amplifier 14 is also provided with a reset switch 27. The TFT 21 and all the switches 23, 24, 25, 26 and 27 are configured by polycrystalline Si TFT elements.

Next will be described the actions of the buffer amplifier 14 with reference to FIG. 5. FIG. 5 is a timing chart of the actions of the buffer amplifier 14. For the convenience of description, the actions of the gate lines 3 for the n-th row and the (n+1)-th row are also shown as gate (n) and gate (n+1), respectively. Further, the actions of the reset switch 27 and the switch 1 (SW1) 23, switch 2 (SW2) 24, switch 3 (SW3) 25 and switch 4 (SW4) 26 are denoted in the chart as reset (27), SW1 (23), SW2 (24), SW3 (25) and SW4 (26), respectively. The upper part of any waveform in this chart represents an on-state of a switch or gate, and the lower part, an off-state. When a gate line 3 is turned on during the reset phase at the beginning of one write period (one horizontal input period), the reset switch 27 is turned on at the same time, and a reference voltage line 8 and a signal line 5 connected thereto are reset to a reset voltage level. Next in a primary precharge phase, the reset switch 27 is turned off, and the switch 1 (SW1) 23 and a switch 4 (SW4) 26 are turned on. At this time, the voltage applied to the input section Vin is entered into the gate of the TFT 21, which then operates as a drain-grounded transistor. As a result, with the threshold voltage of the TFT 21 being represented by Vth, the voltage of the output section Vout is precharged substantially to (Vin−Vth). Hereupon, the voltage Vth is charged to both ends of the offset canceling capacitance Cc22. Then in a secondary precharge phase, the switch 1 (SW1) 23 is turned off, the switch 2 (SW2) 24 is turned on, and the switch 3 (SW3) 25 is turned off. As a voltage (Vin+Vth) is then entered into the gate of the TFT 21 via the offset canceling capacitance Cc22, the voltage of the output section Vout is precharged substantially to Vin. In order to ensure the offset canceling action mentioned above, desirably the switch 1 (SW1) 23 should be turned off a step in advance, and the switch 1 (SW1) 23 should have no unideal characteristic, such as switch feed through. However, since this switch is configured by a polycrystalline Si TFT as stated above, it is more susceptible to such switch feed through than a monocrystalline Si transistor is, moreover with inevitable unevenness. This is due to the distribution of many defect levels in a channel configured of polycrystalline Si. In reality, as a result, even at the end of the second precharge phase, the value of Vout is away from Vin by tens of mV. In view of this problem, in this embodiment, direct writing is done in the following direct input phase to turn on the switch 3 (SW3) 25 and to turn off the switch 4 (SW4) 26. In this procedure, the TFT 21 stops operating because its source is intercepted, and instead the voltage of Vin is directly written into Vout via the switch 2 (SW2) 24 and the switch 3 (SW3) 25. Since the buffer amplifier does not operate in this direct input phase, charging of all the capacitances connected to the reference voltage lines 8 should be carried out via the ladder resistor 15. However, while charging via the ladder resistor 15 where no buffer amplifier 14 is present from the outset would require a few volts enough to drive liquid crystals, the pertinent charging according to the present invention requires only tens of mV, corresponding to the write error having occurred in the secondary precharge phase, only about 1/100 of the voltage requirement in the absence of the buffer amplifier 14. It is possible to design the current drive capacity of the ladder resistor 15 commensurately with this ratio, with the result that the problem of feed through current of the ladder resistor 15 or that of time constant in the direct input phase can be averted. The use of the direct input phase in this embodiment makes it possible to reduce not only the offset errors of the buffer amplifiers 14 but also offset cancellation errors. Moreover in this embodiment, only 64 TFTs 21 are sufficient as active transistors for achieving the above-described effects.

For the operation of this embodiment, though not illustrated in particular, A.C. driving of a common electrode to which the liquid crystal capacitances 2 of pixels is connected is required in addition to the foregoing. In this embodiment, as the DA converters 7 have the same configuration for different signal lines 5, no polarity inversion for liquid crystals can be done row by row or frame by frame as they are. Therefore, to drive such inversion for liquid crystals, A.C. driving of the common electrode is made possible in this embodiment selectively row by row or frame by frame. The A.C. driving row by row here has an effect to restrain flickers on the display screen, while the A.C. driving frame by frame has an effect to reduce power consumption when driving the common electrode.

Switches and transistors in this embodiment are configured by polycrystalline Si TFTs provided over a glass substrate unless otherwise specified. Preparation of these polycrystalline Si TFTs used manufacturing processes commonly well known as low-temperature polycrystalline Si processes. However, the essence of this embodiment does not consist in the manufacturing method or the device structure, and it is evident that if a high-temperature polycrystalline Si TFT, amorphous Si TFT or other device or a quartz, plastic, Si or other substrate is used, a similar effect can be obtained. Or if the voltage relationship is adjusted, it is also possible to change the channel polarity of TFTs in this embodiment from the n type to the p type or to use some other circuit configuration. To add, unless otherwise specified, switches in this embodiment are CMOS analog switches using TFTs, it is also possible to use single-channel switches and still achieve similar characteristics to those of this embodiment.

Although this embodiment uses a common intermediate format (CIF) of 288×352 pixels, the application of the embodiment is not basically restricted by the number of pixels.

Embodiment 2

Embodiment 2 of the present invention will be described below with reference to FIG. 6.

Figure 6:
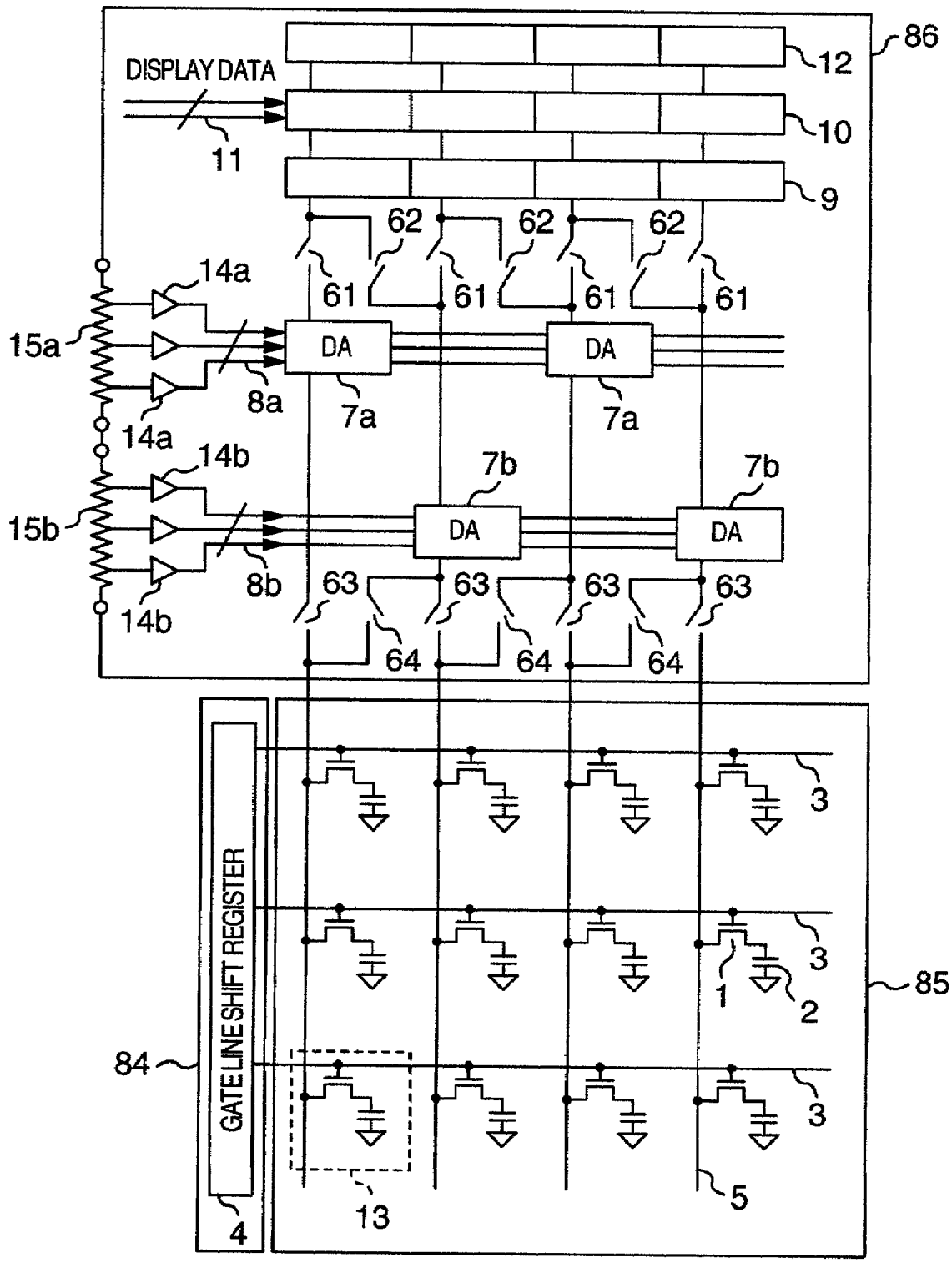
FIG. 6 illustrates a configuration of a polycrystalline Si TFT liquid crystal display panel in Embodiment 2.

FIG. 6 illustrates a configuration of a polycrystalline Si TFT liquid crystal display panel in this Embodiment 2.

As the main configuration and operation of Embodiment 2 are the same as those of Embodiment 1, their description is dispensed with. The differences of this embodiment from Embodiment 1 consist in that an analog circuit comprising the DA converters 7, the reference voltage lines 8, the buffer amplifiers 14 and the ladder resistor 15 is duplicated via change-over switches 61, 62, 63 and 64 and that, though not illustrated, the common electrode to which the liquid crystal capacitances 2 of pixels are connected is held at a D.C. voltage.

In this embodiment, an analog circuit comprising DA converters 7*a*, reference voltage lines 8*a*, buffer amplifiers 14*a* and a ladder resistor 15*a* and another analog circuit consisting of DA converters 7*b*, reference voltage lines 8*b*, buffer amplifiers 14*b* and a ladder resistor 15*b* are switchably connected to odd-number columns and even number columns of signal lines 5 via the change-over switches 61 and 63 and the change-over switches 62 and 64. The reference voltages applied to the ladder resistors 15*a* and 15*b* here are voltages corresponding to polarity inversion driving of liquid crystals, and this embodiment allows choice between row-by-row inversion driving and dot inversion driving of the liquid crystal display screen according to the timing of changing over between the change-over switches 61 and 63 and the change-over switches 62 and 64. While row-by-row inversion driving has the advantage of simpler drive pulses for the change-over switches 61 and 63 and the change-over switches 62 and 64, dot inversion driving has its own effect of restraining cross talk on the screen and resultant improvement in image quality.

Embodiment 3

Embodiment 3 of the present invention will be described below with reference to FIG. 7.

As the main configuration and operation of this polycrystalline Si TFT liquid crystal display panel, which is Embodiment 3 of the invention, are the same as those of Embodiment 1, their description is dispensed with. The difference of this embodiment from Embodiment 1 consists in the configuration of the buffer amplifiers 14. The configuration of the buffer amplifiers 14 in this embodiment will be described below.

Figure 7:
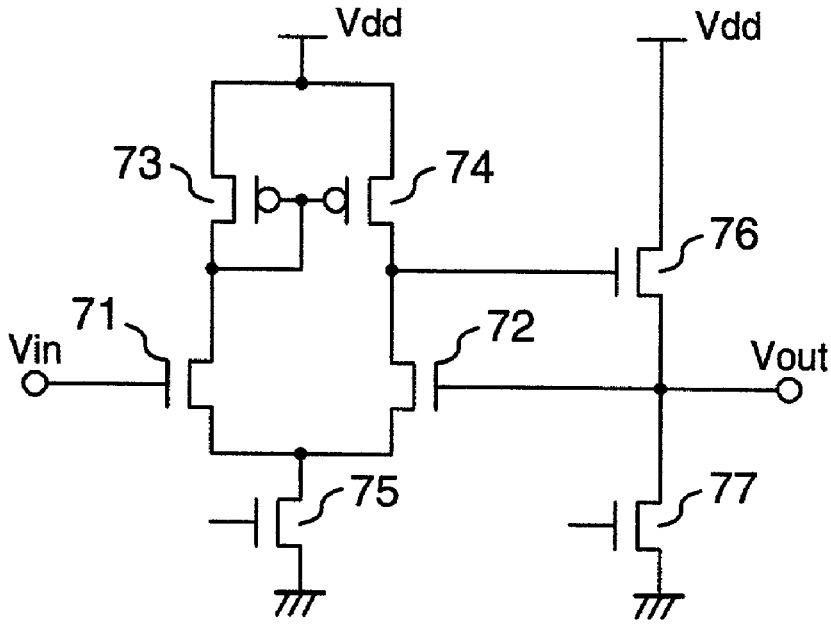
FIG. 7 illustrates a configuration of a buffer amplifier in Embodiment 3.

FIG. 7, illustrating the configuration of a buffer amplifier 14 in this embodiment, corresponds to FIG. 4 for Embodiment 1. This embodiment differs from Embodiment 1 in that, while each buffer amplifier 14 in Embodiment 1 has functions to intercept the outputs of the drain-grounded n-channel TFT, the offset canceler and the buffer amplifier and to short-circuit the input and output sections, each buffer amplifier 14 in this embodiment is configured by a negatively fed-back differential amplifying circuit, but has no function to short-circuit the offset canceler or the input and output sections.

The differential amplifying circuit is configured by a differential circuit consisting of driver TFTs 71 and 72, which are n-channel TFTs, load TFTs 73 and 74, which are p-channel TFTs, and a current source TFT 75; and a source follower circuit consisting of a driver TFT 76 and a current source 77, which are two n-channel TFTs intended for D.C. shifting of the differential circuit output voltage and impedance conversion. The buffer amplifier 14 as a whole operates as a voltage follower as an input section Vin is connected to one of the input terminals of the differential circuit and its output section Vout is fed back to the other input terminal of the differential circuit.

Although the configuration of the buffer amplifier 14 is more complex and the number of TFTs operating as active devices is greater in this embodiment than in Embodiment 1, the number of active devices is far smaller than in the above-described embodiment of the prior art, resulting in a significant yield enhancing effect. Furthermore, as this embodiment involves no offset cancellation, it has an advantage of being simpler to drive than Embodiment 1.

Obviously, this embodiment permits various modifications in circuit without sacrificing any advantage of the invention. Conceivably, for instance, cascode configurations can be applied to the differential circuit and the source follower circuit to enhance the input/output voltage performance of the voltage follower or an additional stage of amplifying circuit can be newly provided to increase the open-circuit gain. It is also conceivable to further enhance the performance of the buffer amplifiers 14 by applying monocrystalline LSIs in this part.

Embodiment 4

Embodiment 4 of the present invention will be described below with reference to FIG. 8.

As the main configuration and operation of this embodiment are the same as those of Embodiment 1, their description is dispensed with. The differences of this embodiment from Embodiment 1 consist in that the configuration of the display pixels 80 use electro-luminescent (EL) display cells in place of liquid crystal display cells.

Figure 8:
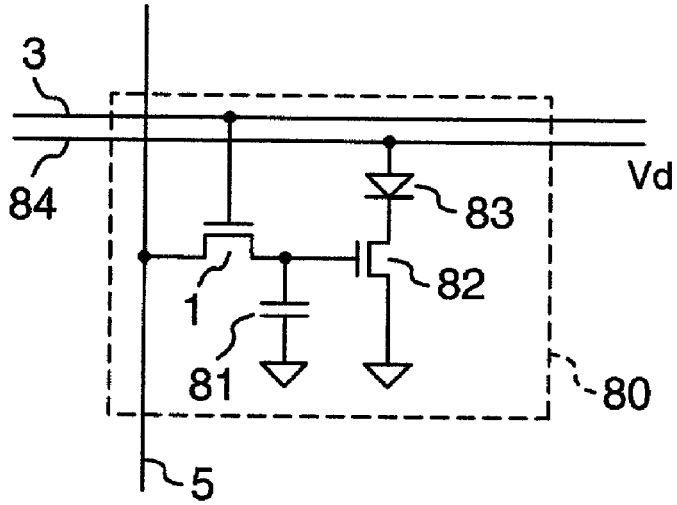
FIG. 8 illustrates a configuration of display pixels in Embodiment 4.

FIG. 8 illustrates a configuration of each display pixel in this embodiment.

The display pixel 80 has a pixel capacitance 81 and a pixel switch 1, of which the gate is connected to a gate line 3 and one end is connected to a signal line 5. Up to this point, its configuration is similar to that of the pixel 13 in Embodiment 1. In this embodiment, however, the pixel switch 1 and the pixel capacitance 81 are directly input to the gate of a current driving TFT 82, whose drain side is connected via an EL diode 83 to a constant voltage line 84 to which a constant voltage Vd is applied. The counter electrode of the pixel capacitance 81 is grounded at a prescribed voltage.

The pixel section of this embodiment will be described below. When the gate line 3 is selected and turned on, an analog image signal voltage applied to the signal line 5 is written into the pixel capacitance 81 via the pixel switch 1 and, even after the pixel switch 1 is turned off by the gate line 3, the written analog image signal voltage is held by the pixel capacitance 81. So far, the operation is substantially the same as that of the pixel 13 of Embodiment 1. In this embodiment, however, when the analog image signal voltage is entered into the gate of the current driving TFT 82, a drive current matching the value of the analog image signal voltage flows to the EL diode 83. This drive current causes the EL diode 83 to emit light at a luminance level matching the analog image signal voltage, and accordingly this embodiment can display by its own luminescence matching the analog image signal voltage applied to the signal line 5.

This embodiment, too, can contribute to enhancing the yield and image quality at the same time, as can Embodiment 1.

To add, being a self-luminescent display panel, this embodiment needs neither a liquid crystal layer nor a back light, both required by Embodiment 1, and the absence of liquid crystal of course means that nothing to convert the analog image signal voltage into an A.C. voltage, such as a liquid crystal capacitance, is required.

Embodiment 5

Embodiment 5 of the present invention will be described below with reference to FIG. 9.

Figure 9:
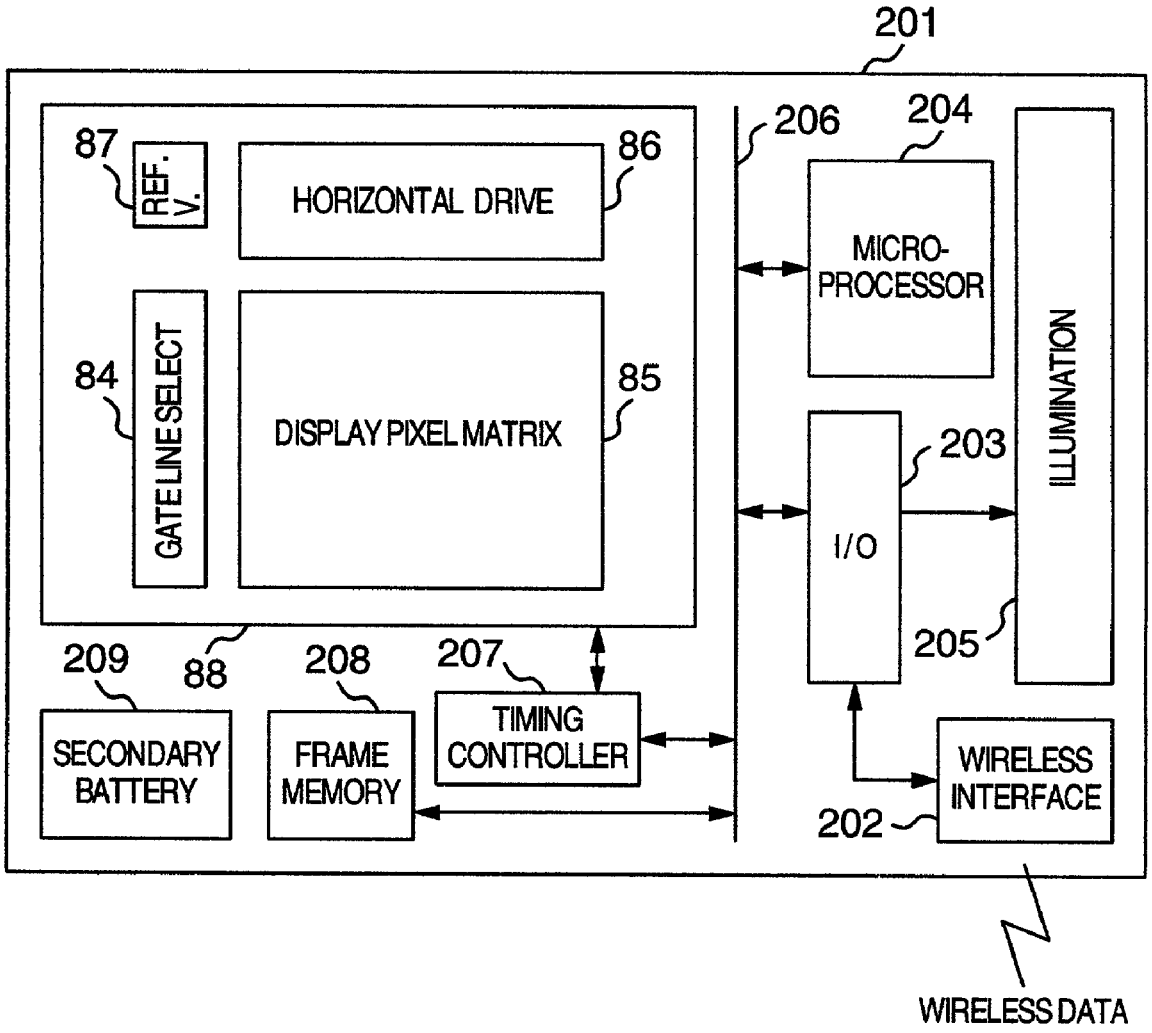
FIG. 9 illustrates an overall configuration of an image display terminal in an image display system, which is Embodiment 5 of the invention.

FIG. 9 illustrates the overall configuration of an image display terminal 201 in an image display system, which is Embodiment 5 of the invention.

Into a wireless interface (I/F) circuit 202, compressed image data are entered from outside as wireless data conforming to the Bluetooth protocol, and the output of the wireless I/F circuit 202 is connected to a bus 206 via an I/O circuit 203. To the bus 206 are also connected a microprocessor 204, a timing controller 207, a frame memory 208 and so forth. The output of the timing controller 207 is entered into a polycrystalline Si TFT liquid crystal display panel 88, which is provided with a reference voltage generating circuit 87, a horizontal drive circuit 86, a gate line selecting circuit 84 and a display pixel matrix 85. Further, the image display terminal 201 is also provided with a secondary battery 209 and an illumination 205, and the illumination 205 is controlled by the I/O circuit 203. Incidentally, as the polycrystalline Si-TFT liquid crystal display panel 88 here has the same configuration and operational features as the above-described Embodiment 1, the description of its internal configuration and operation is dispensed with.

The operation of this Embodiment 5 will be described below. First, compressed image data are entered into the wireless I/F circuit 202 from outside, and transferred via the I/O circuit 203 to the microprocessor 204 and the frame memory 208. As operated by the user, the microprocessor 204 drives the image display terminal 201 for displaying as required or decodes the compressed image data. The decoded image data are temporarily stored in the frame memory 208. If display driving is selected hereupon, the image data are entered from the frame memory 208 via the timing controller 207 into the polycrystalline Si TFT liquid crystal display panel 88 in accordance with an instruction from the microprocessor 204, and the display pixel matrix 85 successively displays the entered image row by row. Hereupon the timing controller 207 simultaneously outputs a prescribed timing pulse required for displaying an image. The process of displaying an image on the display pixel matrix 85 by the polycrystalline Si-TFT liquid crystal display panel 88 using these signals is the same as described with respect to Embodiment 1. On this occasion, the I/O circuit 203 turns on the illumination 205 as required. The secondary battery 209 here supplies power for driving all these units.

This Embodiment 5 contributes to providing an image display terminal capable of high grade displaying of compressed image data at a high yield and a low price.

What is claimed is:

1. An image display apparatus comprising:

a display unit for displaying an image, and a drive unit for driving the display unit, the drive unit being connected by a plurality of signal lines, wherein:

said display unit comprises a plurality of display pixels arranged in a matrix form and the signal lines are arranged in each column, and said drive unit comprises a ladder resistor, impedance converters each having an input connected to an output of the ladder resistor, gray level voltage wires each connected to the output of the impedance converters, gray level voltage selecting means selectively connecting said gray level voltage wires to said plurality of signal lines, wherein said impedance converters have an offset voltage canceling unit for detecting and eliminating any offset voltage between input and output, and wherein the number of said impedance converters matches the number of said gray level voltage wires and matches a number of a plurality of gray level voltage selectors of said gray level voltage selecting means connected to the gray level voltage wires.

2. The image display apparatus as set forth in claim 1, wherein said gray level voltage selectors are connected to said plurality of signal lines.

3. The image display apparatus as set forth in claim 1, wherein said display unit, said gray level voltage selectors and said gray level voltage wires are arranged over the same substrate.

4. The image display apparatus set forth in claim 1, wherein said impedance converters are configured by drain-grounded field effect transistors.

5. The image display apparatus as set forth in claim 1, wherein said impedance converters are configured by differential amplifying circuits using field effect transistors.

6. The image display apparatus as set forth in claim 1, wherein said impedance converters have means for suspending the functioning of the impedance converters and circuits for short-circuiting the input and output terminals of the impedance converters.

7. The image display apparatus as set forth in claim 1, wherein said display pixels are liquid crystal display pixels each having a counter electrode and a liquid crystal region between the pixel electrode and the counter electrode.

8. The image display apparatus as set forth in claim 1, wherein said gray level voltage selectors are configured by an analog switch using a field effect transistor, respectively.

9. The image display apparatus as set forth in claim 1, wherein said ladder resistor is configured by a polycrystalline Si film coped with impurities.

10. The image display apparatus as set forth in claim 1, wherein said display pixels, said gray level voltage selectors and said impedance converters are configured by polycrystalline Si thin film transistors (TFTs).

11. The image display apparatus as set forth in claim 1, wherein said display pixels, said gray level voltage selectors and said impedance converters are configured on the same substrate.

12. The image display apparatus as set forth in claim 1, wherein said ladder resistor is configured by one resistor.

13. The image display apparatus as set forth in claim 1, wherein said ladder resistor is a pair of resistors, one each for positive voltage gray level generation and inverted voltage gray level generation.

14. The image display apparatus as set forth in claim 1, wherein said plurality of display pixels are luminescent type display pixels controlled by entered analog image signals and having a light emitting function for displaying an image with luminescence generated by a current flowing between a positive electrode and a negative electrode.

15. The image display apparatus as set forth in claim 1, wherein said impedance converters are buffer amplifiers.

16. An image display apparatus driving method, comprising:

a step for displaying an image by writing analog image signal voltages via signal lines into pixel capacitances of individual pixels in a display unit, wherein the analog image signal voltages are written into an image display apparatus having a drive unit including a ladder resistor, impedance converters each having an input connected to an output of a ladder resistor, said impedance converters detecting and eliminating any offset voltage, gray level voltage wires each connected to the output of the impedance converters, wherein the number of said impedance converters matches the number of said gray level voltage wires, and matches a number of a plurality of gray level voltage selectors connected to the gray level voltage wires in three separate phases when the analog image signal voltages are written onto the signal lines.

17. The image display apparatus driving method as set forth in claim 16, wherein the writing of the analog image signal voltages onto said signal lines in said image display apparatus uses impedance converters having offset canceling means using offset canceling capacitances, said method comprising the steps of:

in a first phase, simultaneously with the writing of analog image signal voltages using the impedance converters, writing any offset voltage arising between the input and output voltages of the impedance converters into the offset canceling capacitances;

in a second phase following said first phase, simultaneously with the writing using the impedance converters, canceling any offset voltage of the impedance converters using the offset canceling means; and in a third phase following said second phase, writing analog image signal voltages directly onto the signal lines without going through the impedance converters.

18. The image display apparatus driving method as set forth in claim 16, wherein said signal lines are provided with voltage resetting circuits, and analog image signal voltages are written in three separate phases after the voltages of the signal lines are reset in advance by the resetting circuits.

19. A driving method comprising:

a step for displaying in an image display apparatus having a plurality of display pixels arranged in a matrix form to display an image, a group of signal lines provided for each column to transmit analog image signals and connected to the display pixels, and a drive circuit for driving the display pixels and the group of signal lines at prescribed timings, and writing the analog image signal voltages into the pixel capacitances of the display pixels to display an image, wherein:

said drive circuit having a ladder resistor and a plurality of gray level voltage wires each connected through a plurality of impedance converters, respectively to an output of the ladder resistor, said impedance converters detecting and eliminating any offset voltage;

said group of signal lines are connected to said gray level voltage wires via a gray level voltage selector;

each gray level voltage wire is connected to the output of the impedance converters, respectively, wherein the number of said impedance converters matches the number of said gray level voltage wires;

at least the display pixels, the group of signal lines, the gray level voltage selector and the gray level voltage wires are provided over the same substrate; and wherein the analog image signal voltages are written in three separate phases when the analog image signal voltages are to be written onto the signal lines.

20. An image display terminal system, comprising:

a plurality of display pixels arranged in a matrix form to display an image;

a group of signal lines provided for each column to transmit analog image signals and connected to the display pixels;

a drive circuit for driving the display pixels and the group of signal lines at prescribed timings; and means for causing the display pixels to display an image in a prescribed sequence on the basis of inputted image display data, wherein:

said drive circuit has a ladder resistor and a plurality of gray level voltage wires each connected through a plurality of impedance converters, respectively to an output of the ladder resistor;

said group of signal lines are connected to the gray level voltage wires via a gray level voltage selector;

each of said gray level voltage wires connected to the output of the impedance converters, respectively, wherein the number of said impedance converters matches the number of said gray level voltage wires, wherein said impedance converters have an offset voltage canceling unit for detecting and eliminating any offset voltage between input and output; and at least the display pixels, the group of signal lines, the gray level voltage selector and the gray level voltage wires are provided over a single substrate.

21. The image display terminal system as set forth in claim 20, wherein said impedance converters are buffer amplifiers.

* * * * *